US007637183B2

(12) United States Patent
Alvarado

(10) Patent No.: US 7,637,183 B2
(45) Date of Patent: Dec. 29, 2009

(54) METHOD OF USING ADJUSTABLE PIVOTAL WRENCH

(76) Inventor: Gabriel Alvarado, 5842 Crestgrove Dr., Corpus Christi, TX (US) 78415-3843

( * ) Notice: Subject to any disclaimer, the term of this patent is extended or adjusted under 35 U.S.C. 154(b) by 0 days.

(21) Appl. No.: 12/008,174

(22) Filed: Jan. 10, 2008

(65) Prior Publication Data

US 2008/0178710 A1 Jul. 31, 2008

Related U.S. Application Data

(60) Provisional application No. 60/897,470, filed on Jan. 26, 2007.

(51) Int. Cl.
*B25B 13/00* (2006.01)
*B25B 23/16* (2006.01)

(52) U.S. Cl. ..... 81/120; 81/177.8

(58) Field of Classification Search ..... 81/120, 81/176.1, 177.7, 177.8; 29/426.1
See application file for complete search history.

(56) References Cited

U.S. PATENT DOCUMENTS

| | | | | | |
|---|---|---|---|---|---|
| 330,594 | A | * | 11/1885 | Lea | 81/158 |
| 744,271 | A | * | 11/1903 | Adams | 81/177.9 |
| 964,067 | A | | 7/1910 | Steen | |
| 1,058,624 | A | * | 4/1913 | Osborn et al. | 81/120 |
| 1,080,121 | A | | 12/1913 | Oriol | |
| 1,144,907 | A | * | 6/1915 | Knipple | 81/177.9 |
| 1,302,197 | A | | 4/1919 | Miller | |
| 1,428,805 | A | * | 9/1922 | Reynolds et. al. | 81/177.9 |
| 1,568,442 | A | * | 1/1926 | Carver | 81/177.8 |
| 1,822,428 | A | * | 9/1931 | Zilliox | 81/177.8 |
| 2,539,262 | A | * | 1/1951 | Moore | 81/119 |
| 2,682,189 | A | * | 6/1954 | Bergman | 81/119 |
| 4,315,447 | A | | 2/1982 | Tartaglia | |
| 4,715,252 | A | * | 12/1987 | Pella | 81/176.1 |
| 4,991,469 | A | * | 2/1991 | Pella | 81/176.2 |
| 5,520,210 | A | | 5/1996 | Barton | |
| 5,870,932 | A | * | 2/1999 | Brooke | 81/177.8 |
| 6,145,416 | A | | 11/2000 | Bonniot | |
| 6,234,049 | B1 | | 5/2001 | Ju | |
| 6,349,620 | B1 | * | 2/2002 | Anderson | 81/73 |
| 6,349,622 | B1 | * | 2/2002 | Lemaire et al. | 81/124.4 |
| 6,382,058 | B1 | * | 5/2002 | Owoc | 81/177.9 |
| 6,877,404 | B2 | | 4/2005 | Chen | |
| 7,197,965 | B1 | * | 4/2007 | Anderson | 81/73 |
| 7,328,634 | B1 | * | 2/2008 | Greenberg et al. | 81/73 |
| 2006/0191382 | A1 | * | 8/2006 | Pettit | 81/60 |
| 2007/0062346 | A1 | * | 3/2007 | Hsieh | 81/177.7 |

* cited by examiner

*Primary Examiner*—David B Thomas
(74) *Attorney, Agent, or Firm*—G. Turner Moller

(57) ABSTRACT

In one embodiment, a specialty wrench has a handle that is movable from a first position where the wrench acts as a conventional pipe or Stillson wrench and a second position where the handle is inclined, perhaps as much as 90°. The wrench can be used to start rotation of a valve wheel. After the valve wheel has been broken or started, the wrench handle is pivoted to a position where the valve wheel may be continuously rotated to either its open or closed position. In another embodiment, the jaw end of the wrench is angularly adjustable about a longitudinal axis so the wrench has another mode of operation, i.e. where the wrench may be used on conventional threaded connections.

6 Claims, 2 Drawing Sheets

Fig.2
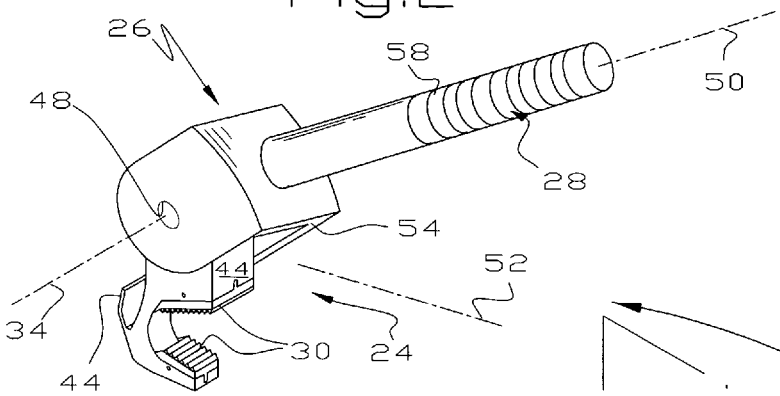
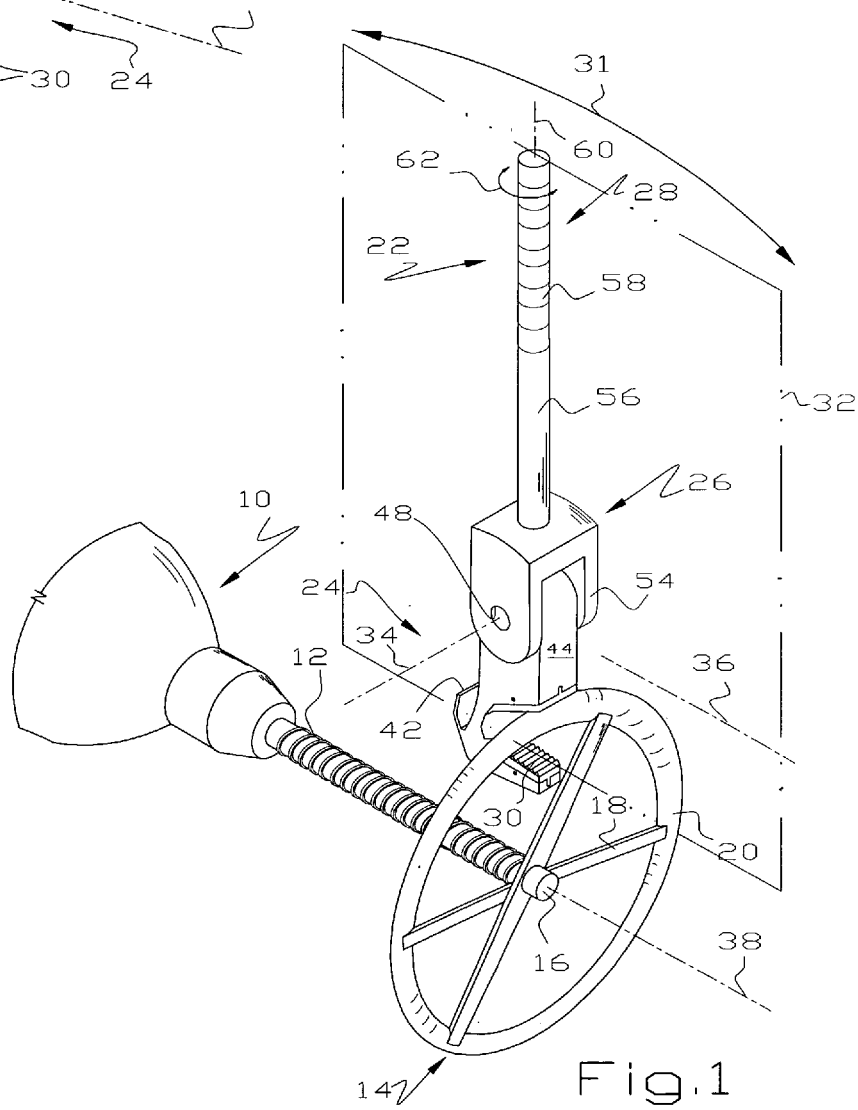
Fig.1

84
88
88
86
20
72
70
78
80
82
100
110
112
104
108
106
98
92
90
74
94
102
96
76
172
174
166
122
164
168
162
150
152
154
158
160
170
156
174
134
136
132
20
138
128
120
140
124
130
142
126
60
64
66
28
58
68
66

METHOD OF USING ADJUSTABLE PIVOTAL WRENCH

This application is based on Provisional Application Ser. No. 60/897,470 filed on Jan. 26, 2007 from which priority is claimed.

This invention relates to a wrench and more particularly to a wrench having a pivoted handle to change the mechanical advantage of the wrench.

BACKGROUND OF THE INVENTION

Large valves often have a substantial sized wheel that is turned to open or close the valve. Sometimes, these valves are so hard to turn that a wrench is needed to turn them. Conventionally, an adjustable pipe wrench, often called a Stillson wrench, is used to turn the wheel operators of large valves. In the alternative, a fixed jaw wrench is often used to turn the wheel operators of large valves.

When using a conventional pipe wrench, having either fixed or adjustable jaws, to open or close a wheeled valve operator, a series of repeated actions are necessary: engage the wrench on the perimeter of the wheel, turn the wheel in either the clockwise or counterclockwise direction until further movement of the wrench handle is obstructed, lift the wrench off the wheel, return the wrench to the point of origin and repeat the same series of actions. This is repeated until the valve reaches the open or closed position or it loosens up enough to turn the wheel without the wrench.

It is known in the prior art to provide wrenches having pivoted handles for changing the mechanical advantage of the wrench as shown in U.S. Pat. Nos. 964,067; 1,080,121; 1,302,197; 6,234,049 and 6,877,404. A close analysis of these patents reveals that prior art wrenches that have the ability to grasp or grapple with a wheel operator pivot the handle in the wrong direction. In addition, of some relevance are U.S. Pat. Nos. 4,315,447; 5,520,210 and 6,145,416.

SUMMARY OF THE INVENTION

In this invention, a wrench is provided with a handle having a pivoted joint. In one angular position of the handle, the wrench provides a maximum lever arm to initiate rotation of the wheel operator. When the valve operator beings to turn, the handle is manipulated to a different angular position to allow more rapid rotation of the wheel operator. This inherently decreases the mechanical advantage of the lever arm.

This invention accordingly eliminates the lifting up and removal of the valve wrench at the end of the initial turn and instead allows the operator to continue rotation of the valve wheel. This is accomplished by pivoting the handle in a desired direction so movement of the valve wheel is started with a maximum length lever arm provided by the wrench. After the valve wheel is initially moved and movement of the valve wheel becomes easier, the wrench handle is pivoted in a manner that allows continuous rotation of the valve wheel until either the open or closed position is reached. The elimination of stopping rotation, lifting the wrench off the valve wheel, replacing the valve wrench on the valve wheel and rotating the valve wheel again makes this invention efficient and productive.

Thus, the wrench of this invention differs from a conventional pipe wrench by the dual action of the handle provided by a pivot pin that changes the lever arm of the wrench from a maximum length needed to start rotation of the valve wheel and a shorter length allowing continuous rotation of the valve wrench.

Another important feature of this invention is a handle on the wrench that is rotatable. When the user pivots the wrench handle to the faster speed, lower torque position and rotates the valve wheel operator, the rotatable handle allows rapid rotation with no relative movement between the handle and the user's hand.

In one embodiment of this invention, a wrench head is rotatable on the end of a pivot assembly allowing the wrench of this invention to be converted from pivoting in different directions relative to the wrench head.

It is an object of this invention to provide an improved valve wrench.

A further object of this invention is to provide a valve wrench having an adjustable handle providing a maximum lever arm for maximum torque and a shorter handle allowing continuous rotation of the valve wheel.

Another object of this invention is to provide a wrench having a rotatable handle allowing rotation of the wrench with no relative movement between the wrench handle and the user's hand.

A further object of this invention is to provide a wrench having a wrench head that is pivoted or rotatable relative to a wrench handle.

Another object of this invention is to provide an improved method for opening and closing wheel operated valves.

These and other objects and advantages of this invention will become more apparent as this description proceeds, reference being made to the accompanying drawings and appended claims.

BRIEF DESCRIPTION OF THE DRAWINGS

FIG. 1 is an isometric view of a valve wheel showing a wrench of this invention starting to rotate the wheel;

FIG. 2 is an isometric view of the wrench of this invention showing the handle pivoted to a position allowing continuous rotation of the valve wheel;

DETAILED DESCRIPTION

Figures 3, 4, 5, 6:
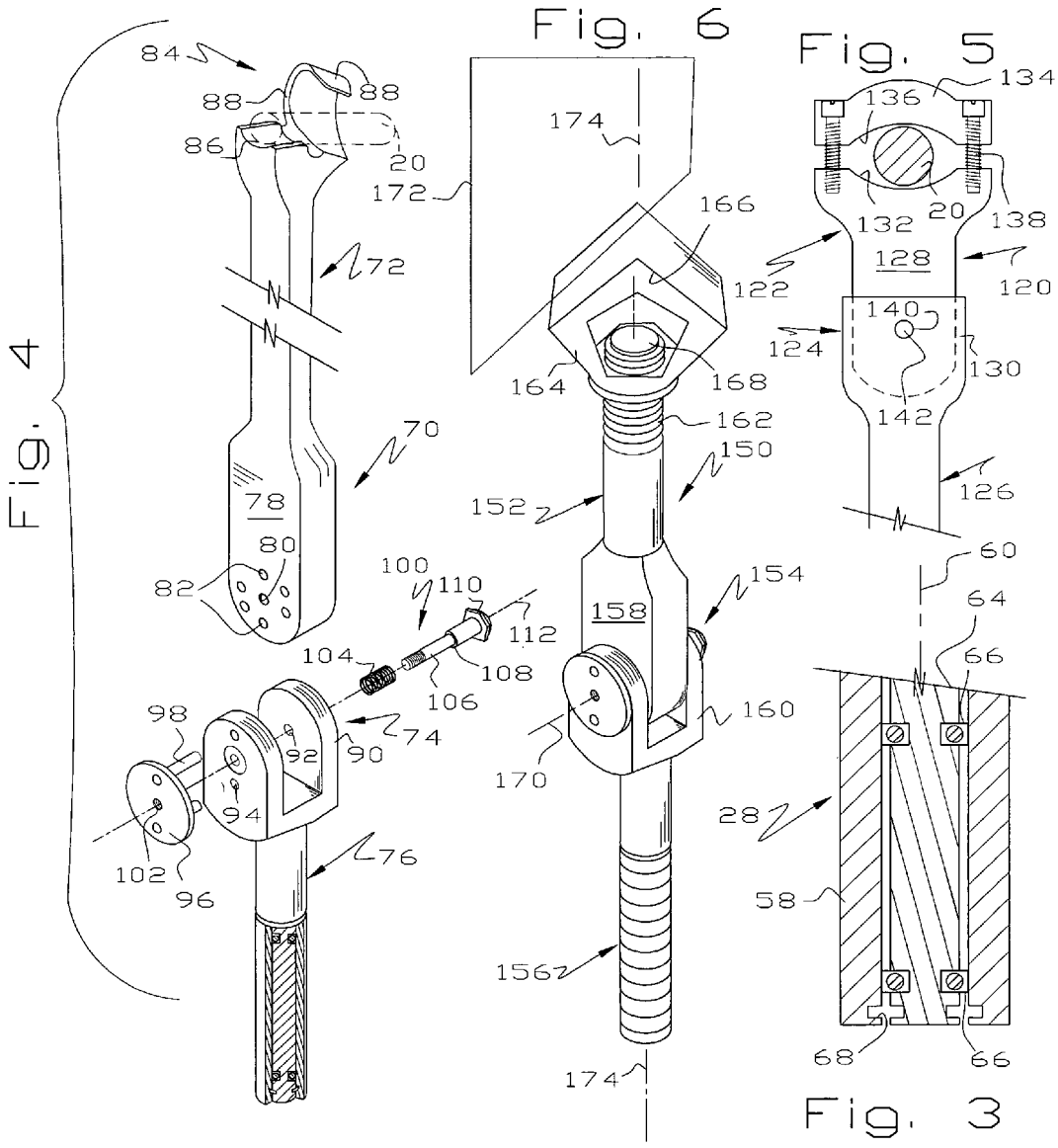
FIG. 3 is an enlarged cross-sectional view of the handle end of this invention.
FIG. 4 is an isometric view of another embodiment of the wrench of this invention and illustrated an exploded view of the pivot connection between the handle and the jaw end.
FIG. 5 is a partial side view of a further embodiment of this invention.
FIG. 6 is an isometric view of another embodiment of this invention.

Referring to FIGS. 1 and 2, a conventional valve 10 includes a shaft or stem 12 which, when turned, moves a valve element (not shown) inside the valve 10 between open and closed positions. A conventional operator wheel 14 is attached to the shaft 12 in any suitable manner and includes a hub 16 and a plurality of spokes 18 connected to a circular rim 20 which is typically, but not universally, of circular cross section. It will be seen that the valve wheel 14 is generally planar and is perpendicular to its axis of rotation provided by the valve stem 12. Those skilled in the art will recognize the valve 10 as being typical of large valves used in refineries, chemical plants, pipelines and the like. Many valves 10 are located adjacent other equipment, pipelines or the like so that turning the wheel 14 with a conventional wrench often results in the wrench striking an adjacent object thereby limiting rotation of the wrench when applied to the wheel 14.

A wrench 22 of this invention comprises, as major components, a head or jaw end 24, a pivot assembly 26 and a handle 28. In one embodiment, shown in FIGS. 1 and 2, the jaw end 24 includes fixed jaws 30. In the alternative, the jaws 30 may be adjustable, in the manner of a Stillson wrench. The wrench 22 is accordingly provided with a jaw end 24 which can receive or grasp the rim 20 of the valve wheel 14.

In FIG. 1, the wrench 22 is being used, in the same manner as a conventional pipe wrench, to start rotation of the valve wheel 14. In other words, the jaws 30 are placed around the rim 20, the handle extension 28 is moved in an arc 31 parallel to the wheel 14 to rotate the wheel 14 in either an opening or closing direction. It will be apparent that the wrench 22 may be provided in any suitable size or range of sizes, depending on the size of the valve 10 and the forces necessary to rotate the valve wheel 14.

It will be seen that the head or jaw end 24 defines a plane 32 perpendicular to the rim 20 and the handle 28 lies in the plane 32. In other words, the entire tool 22 lies in the plane 32 in the handle position of FIG. 1 and the plane 32 intersects the valve stem 12 along its length. Viewed in another manner, as shown in FIG. 1, the jaws 30 diverge in the plane 32. It will also be seen that the wheel 14 is generally planar and the wrench 22 lies in a plane 32 that is perpendicular to the wheel 14.

After the wheel 14 is moved and the internal components of the valve break apart, it becomes much easier to rotate the wheel 14. In other words, the maximum lever arm provided by the wrench 22 in the position of FIG. 1 is no longer necessary to rotate the wheel 14. So, as shown in FIG. 2, the pivot assembly 26 is manipulated to allow the handle 28 to pivot about an axis 34 and thereby place the handle 28 more-or-less parallel to the valve stem 12 as suggested by the line 36 in FIG. 1. This allows a user to rotate the wheel 14 by rotating the handle 28 about the axis 38 of the valve stem 12. It will be seen that the handle 28 lies in the plane 32 in the position of FIG. 1, lies in the plane 32 in the position of FIG. 2 and that the pivot assembly 26 constrains movement of the handle 28 to movement in the plane 32. This is in contrast to disclosures such as U.S. Pat. No. 1,080,121 where the handle is pivoted to a position generally perpendicular to the plane defined by the jaws of the wrench. Thus, in this invention, the plane 32 divides the jaws 30 into mirror image halves.

As shown in FIGS. 1 and 2, one embodiment of the head 24 comprises a solid body 40 receiving the jaws 30, which may be replaceable, a hook 42 opposite from the jaws 30 and a central section 44 to which the pivot assembly 26 is attached. The purpose of the hook 42 is to allow the user to unscrew a cap on an industrial fire hydrant.

The pivot assembly 26 is more completely illustrated and described in connection with FIG. 4. A button 48 or other similar operator is manipulated to break the drive connection between the handle 28 and the jaw end 24 so the handle 28 may be pivoted from an upright position shown in FIG. 1 and illustrated by the axis 50 in FIG. 2 to one or more intermediate positions shown in FIG. 2 to a perpendicular position illustrated by the axis 52 in FIG. 2. It will be apparent that the axis 52 substantially corresponds to the axis 36 in FIG. 1.

The handle 22 comprises a forked section 54 pivoted to the jaw end 24, a handle section 56 fixed to the forked section 54 and a handle end or sleeve 58 which is rotatable relative to the section 56 as shown most clearly in FIGS. 3 and 6. The handle end 58 is accordingly rotatable about an axis 60 as suggested by the arrow 62. To this end, the handle section 56 includes a stem 64 inside the handle end 58 having one or more bearings 66 mounting the handle end 58 for rotation. Slots 68 on the handle end 58 and stem 64 are provided to receive a key (not shown) to retain the handle end 58 on the stem 64. It will accordingly be seen that the bearings 66 may be inserted onto the stem 64 as the handle end 58 is slipped over it followed by insertion of a key (not shown) into the slots 68.

It will be seen that the handle end 58 rotates easily about the axis 60. After the wrench 22 has been used, as in FIG. 1 to loosen the valve 10, the handle 28 is pivoted into a position where the handle end 58 lies along the line 36 or along the axis 52. The user then grasps the handle end 58 and rotates the wrench 22 about the axis 38 thereby opening or closing the valve 10, depending on the direction of rotation. It will be seen that the wrench 22 provides a maximum lever arm in FIG. 1 to loosen the valve 10 and then, after adjusting the handle 28, provides a shorter lever arm capable of much greater speed. Because the sleeve 58 rotates about the stem 64, there is no relative movement between the sleeve 58 and the user's hand during rotation of the wrench 22 about the axis 38 when the handle 28 is aligned with the axis 36. It will accordingly be seen that the rotatable handle end 58 comprises an important feature of this invention.

Referring to FIG. 4, another embodiment of a wrench 70 comprises, as major components, a jaw end 72, a pivot connection 74 and a handle 76. The jaw end 72 includes a flat central section 78 having a through hole 80 and a series of recesses 82 in a circular pattern for cooperation with the pivot connection 74 as explained more fully hereinafter. The jaw end 72 also includes a conventional grasping or grappling element 84 which is known in the trade as a non-slip or sure grip wrench that is sized and shaped to receive the rim 20 of the wheel operator 14. The element 84 includes a semicircular trough 86 receiving the rim 20 of the wheel 14 and a hook 88 allowing the jaw end 72 to apply torque to the wheel 14. It will be seen that the element 84 is configured to grapple the rim 20 of the valve operator wheel 14 in such a manner that a plane perpendicular to the rim 20 is more-or-less perpendicular to the rim 20. Thus, the grappling element 84 is essentially the same as the open jaw wrench end 24.

For purposes of illustration, the pivot connection 74 and handle 76 are intended to be identical to the pivot connection 26 and handle 28. The pivot connection 74 accordingly comprises a pair of forks 90 fixed to the handle 76 and straddling the central section 78 having a pair of through holes 92 aligned with the hole 80 and a pair of recesses or holes 94 extending through one of the forks 90 into engagement with a selected pair of the recesses 82 thereby providing a drive connection where the axis of the handle 76 is parallel to the axis of the jaw end 72. The pivot connection 74 also comprises an angular selection wheel 96 having a pair of prongs 98 sized and placed to pass through the holes 94 and be received in another selected pair of the recesses 82. It will be seen that the prongs 96 fix the angular position of the handle 76 relative to the jaw end 72 and transmit torque applied to the handle 76 to the jaw end 72. The pivot connection 74 accordingly provides a series of angular drive connections, one of which places the handle 90° offset to the position of FIG. 1. The number of angularly offset positions of the handle 28 is accordingly limited only by the number of recesses 82 provided in the jaw section 78.

A threaded fastener 100 extends through the holes 92, 80 to connect the pivot connection 74 an handle 76 to the jaw end 72. The fastener 100 threads into a hole 102 in the wheel 96 and a spring 104 surrounds a shank 106 of the fastener 100 and abuts a shoulder 108 thereby biasing the selection wheel 96 and the threaded fastener 100 to the right in FIG. 4. By pressing on an end 110 of the fastener 100, the wheel 96 and prongs 98 move to the left in FIG. 4 a amount sufficient to allow retraction of the prongs 98 from the recesses 82. It will be evident that the amount of movement is not large. This allows the jaw end 72 to be pivoted about an axis 112 which corresponds to the axis 34 of FIGS. 1 and 2. It will be apparent that any suitable pivotal connection may be used in this invention provided it is capable of transmitting torque in a variety of angular positions and is reasonably stable in any of its torque transmitting positions. The handle 76 is conveniently the same as the handle 28.

It will be apparent that operation of the wrench 70 is the same as the wrench 22 except that the element 84 grapples onto the wheel rim 20 in a slightly different manner. Thus, the wheel 14 is initially turned with the handle 76 aligned with the jaw end 72 until the valve 10 loosens up. Then, the handle 76 is pivoted to an angularly offset position, typically perpendicular to its original position, so the valve wheel 14 can be turned faster.

Referring to FIG. 5, another wrench 120 of this invention is illustrated comprising, as major components, a jaw end 122, a pivot connection 124 and a handle 126. The pivot connection 124 and the handle 126 are preferably the same as previously described. The valves 10 are sometimes of a type that are open, or closed, for long periods and are manipulated only in more-or-less emergencies. The jaw end 122 is designed to more-or-less permanently clamp onto the wheel rim 20 so the wrench 120 is intended to be fastened to the valve 10 so it is always in a position to be used.

Thus, the jaw end 122 includes a central section 128 received in a fork 130 of the pivot connection 124 and having a first concave jaw recess 132. A clamp 134 provides a second concave jaw recess 136 for receiving the wheel rim 20 while suitable fasteners 138 secure the clamp 134 to the central section 128. The pivot connection 124 provides a button 140 analogous to the fastener end 110 for manipulating the pivot connection and allowing pivotal movement of the handle 126 about an axis 142 relative to the jaw end 122.

It will be apparent that operation of the wrench 120 is the same as the wrenches 22, 70 except that the clamp 134 grasps onto the wheel rim 20 in a slightly different manner. Thus, the wheel 14 is initially turned with the handle 126 aligned with the jaw end 122 until the valve 10 loosens up. Then, the handle 126 is pivoted to an angularly offset position, typically perpendicular to its original position, so the valve wheel 14 can be turned faster.

Even thought the wheel grappling element of wrenches 22, 70, 120 vary considerably in shape and complexity, they have in common a configuration that is capable of applying torque to the rim 20 of the valve wheel 14 and is perpendicular to the rim 20. In addition, the handles 22, 76 and 126 are pivoted about axes perpendicular to the plane so the handles move in the plane.

Referring to FIG. 6, there is illustrated another wrench 150 comprising a jaw end or segment 152, a pivot connection 154 and a handle 156. The pivot connection 154 and the handle 156 are preferably the same as previously described. The jaw end 152 includes a central section 158 received between the forks 160 of the pivot connection 154 and having threads 162 securing a wrench end 164 to the central section 158. The wrench end 164 is of closed pentagonal shape for receiving a bolt head on a fire hydrant. A resilient pad 168 is provided on the end of the threads 162 for purposes more fully apparent hereinafter. In use, the wrench end 164 is placed on the fire hydrant bolt and the handle 156 turned until the pad 168 presses firmly against the bolt head. After snugging up, the pad 168 allows about one more revolution to position the handle 156 so the pivot axis 170 is either perpendicular to the plane 172 or parallel to it. When the pivot axis 170 is parallel to the plane 172, the wrench 150 works in the same manner as in U.S. Pat. No. 1,080,121. When the pivot axis 170 is perpendicular to the plane 172, the wrench 150 works in the same manner as the wrenches 22, 72, 120. Thus, a connection which allows rotation of a wrench end 164 about an axis 174 creates a dual function wrench, i.e. one which may be used to open a valve and may be used on a conventional threaded connection. It will be apparent that this connection may be of a type other than a threaded connection, such as an angularly adjustable connection analogous to the pivot connection 74. It is equally apparent that the wrench end is subject to considerable variation. A particularly useful wrench end for the wrench 150 is an adjustable jaw wrench threaded onto the threads 162 or a fixed jaw wrench of the type shown in FIGS. 1-2 threaded onto the threads 162.

It is apparent that jaw ends of many different configurations may be attached to the pivot connection and handle of this invention.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. The method of manipulating a valve having a valve stem operating internal components of the valve and a wheel, having a rim, on the valve stem for rotating the stem and thereby operating the valve by use of a wrench including a jaw end configured to engage the valve wheel; a handle and a pivot connecting the handle and the jaw end for pivoting the handle from a first position where the handle is generally perpendicular to the valve stem to a second position where the handle is generally parallel to the valve stem, the handle and jaw end defining a common plane in the first and second positions of the handle, the method comprising placing the jaw end onto the wheel rim, the handle being generally perpendicular to the valve stem, applying a first force to the handle with the handle generally perpendicular to the valve stem, rotating the wheel and initiating rotation of the valve stem in a first direction, and then moving the valve handle to a position generally parallel to the valve stem, applying a second force to the handle with the handle generally parallel to the valve stem thereby reducing the mechanical advantage of a lever arm provided by the handle and rotating the wheel in the first direction.

2. The method of claim 1 wherein the moving step occurs after less torque is required to rotate the valve stem.

3. The method of claim 1 wherein the second force is smaller than the first force.

4. The method of claim 1 wherein the handle includes an outer section rotatable relative to an inner section and further comprising grasping the outer section and applying the second force to the handle with the handle generally parallel to the valve stem so the outer section rotates relative to the inner section during rotation whereby the outer section does not rotate relative to a user's hand.

5. The method of claim 1 wherein the jaw end comprises jaws.

6. The method of claim 1 wherein the jaw end comprises adjustable jaws.

* * * * *